US007059932B1

(12) United States Patent
Tobias et al.

(10) Patent No.: US 7,059,932 B1
(45) Date of Patent: Jun. 13, 2006

(54) SPINNING TOY

(75) Inventors: Jacqui Tobias, Bentleigh East (AU); Paul Charlwood, Melbourne (AU)

(73) Assignee: Moose Enterprise Pty Ltd, Bentleigh East Victoria (AU)

( * ) Notice: Subject to any disclaimer, the term of this patent is extended or adjusted under 35 U.S.C. 154(b) by 0 days.

(21) Appl. No.: 10/512,032

(22) PCT Filed: Apr. 27, 2004

(86) PCT No.: PCT/AU2004/000539

§ 371 (c)(1),
(2), (4) Date: Jul. 19, 2005

(87) PCT Pub. No.: WO2004/091745

PCT Pub. Date: Oct. 28, 2004

(51) Int. Cl.
*A63H 1/30* (2006.01)

(52) U.S. Cl. ..... 446/250

(58) Field of Classification Search ..... 446/247–254, 446/235–236, 259, 261–263
See application file for complete search history.

(56) References Cited

U.S. PATENT DOCUMENTS 2,337,334 A * 12/1943 Lohr ..... 446/250
6,354,905 B1 * 3/2002 Haines et al. ..... 446/250
6,599,165 B1 * 7/2003 Van Dan Elzen ..... 446/250

FOREIGN PATENT DOCUMENTS

GB 186281 9/1922

* cited by examiner

*Primary Examiner*—Eugene Kim
*Assistant Examiner*—Alyssa M. Lowen
(74) *Attorney, Agent, or Firm*—The Webb Law Firm

(57) ABSTRACT

A spinning toy comprises a pair of spaced disc bodies connected by a transverse shaft forming a gap therebetween. A sting is attached to the shaft in the gap and the toy can be spun on the string. A release mechanism releases the attachment of the string on the shaft while the toy is spinning.

20 Claims, 6 Drawing Sheets

10
15
16
42
76
40
78

61
70
75

80

12
60
87
59
11
66

SPINNING TOY

BACKGROUND OF THE INVENTION

1. Field of the Invention

The present invention relates to a spinning toy, and particularly to a yo-yo type toy.

2. Description of Related Art

In their simplest form yo-yo's have been known since ancient times. The traditional yo-yo design comprises a spool where two disc bodies are attached by an axle. A length of string is securely tied to the axle or, in more modern designs, the string is looped around the axle to allow free movement of the string relative to the spinning spool.

More sophisticated yo-yo designs aim to increase game flexibility and play 'tricks' by reducing spinning friction and introducing 'sleeping' action, which is where a user is able to make a yo-yo spin on the end of its string without winding back up. These designs may include mounting the axle on a ball bearing assembly or adding a centrifugal clutch that has the effect of automatically winding the string back onto the yo-yo.

The present spinning toy achieves an even greater flexibility of game playing.

SUMMARY OF THE INVENTION

In one aspect of the present invention there is a spinning toy comprising a pair of spaced disc bodies joined by a transverse shaft forming a gap therebetween, a string attached to the shaft in the gap whereby the toy can be spun on the string, and a release mechanism for releasing the attachment of the string on the shaft while the toy is spinning.

In a further aspect of the present invention there is a method of using a spinning toy having a pair of spaced disc bodies connected by a transverse shaft forming a gap therebetween, and a string attached to the shaft in the gap, the method including:

spinning the connected disc bodies relative to the string by unwinding the disc bodies from the string;

lowering the spinning disc bodies towards a surface to activate a release mechanism that releases the string from the shaft; and retaining hold of the string and allowing the disc bodies to freely roll along the surface.

BRIEF DESCRIPTION OF THE DRAWINGS

The present invention is described further by way of example with reference to the accompanying drawings of which.

DETAILED DESCRIPTION OF THE PREFERRED EMBODIMENTS

Figure 1:
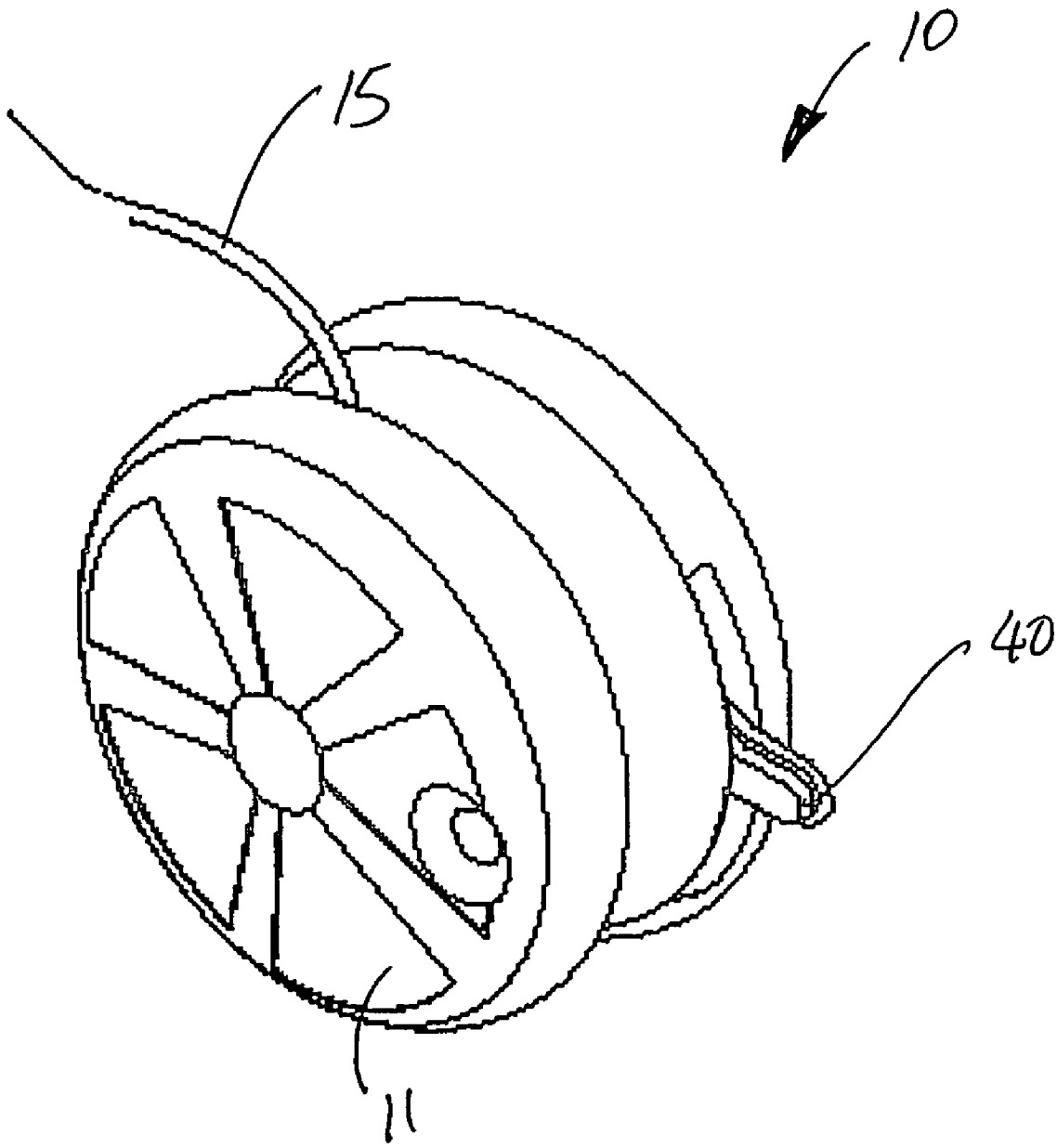
FIG. 1 is a perspective view of a spinning toy in accordance with a first embodiment of the present invention.

The embodiments of a spinning toy 10 illustrated in the drawings shows a yo-yo type toy that can function as a regular yo-yo to spin away from and back to a user's hand, but which also has a release mechanism 17 that will detach the string from the yo-yo when the yo-yo closely approaches a surface. Once the string is detached the yo-yo assumes the characteristics of a spinning wheel and rolls along the surface.

In a preferred embodiment the toy may be used as a regular yo-yo but has the option of switching to a state whereby a force on the circumference of the yo-yo will cause the string to detach and allow the remaining body of the yo-yo to roll and run free across the surface while the string remains behind in the hands of the user.

FIGS. 1 to 3B illustrate a first embodiment of the spinning yo-yo toy 10. The yo-yo comprises a pair of spaced disc bodies 11,12, that are joined by a transverse shaft 13, wherein the spacing between the disc bodies forms a circumferential gap 14. A string 15 is detachably connected to the shaft by way of a spindle 16.

Figure 2C:
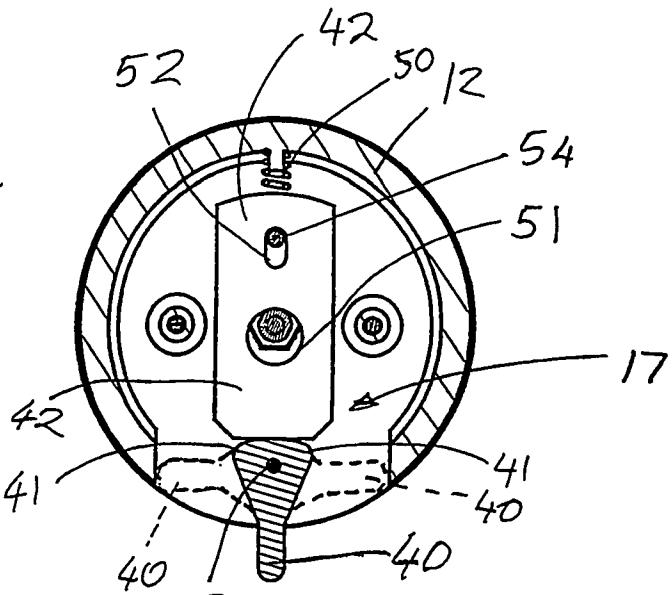
FIG. 2C is a sectional view of the spinning toy taken at line B—B of FIG. 2B.
Figure 2B:
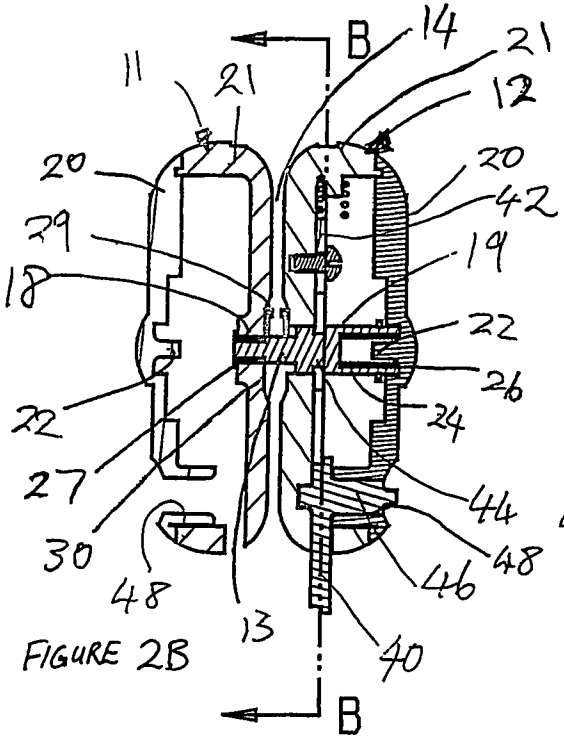
FIG. 2B is a side sectional view of the first embodiment.
Figure 2A:
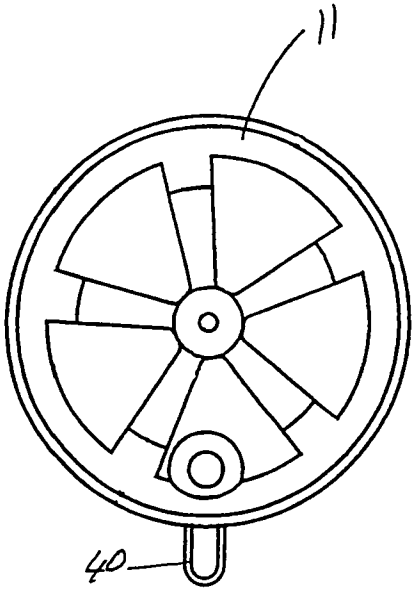
FIG. 2A is a front profile of the first embodiment of a spinning toy.
Figure 3B:
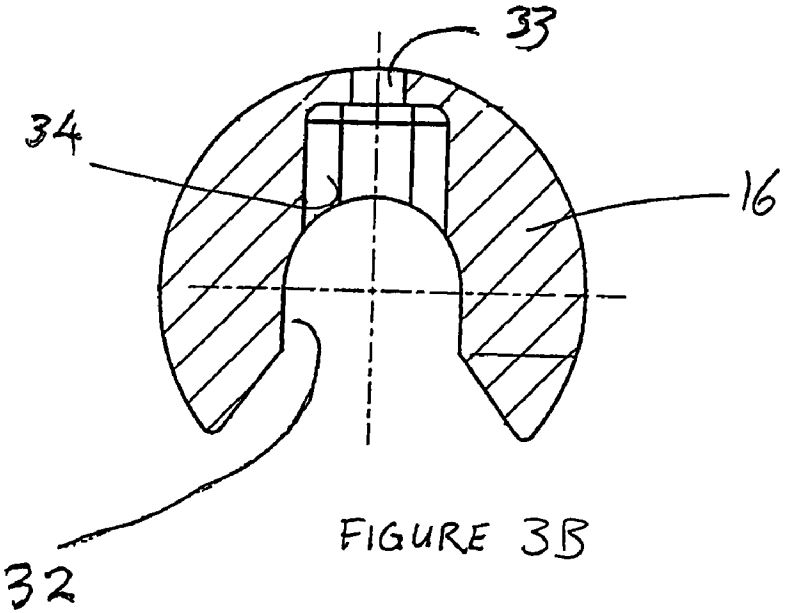
FIG. 3B is a front sectional view of the spindle of FIG. 3A.
Figure 3A:
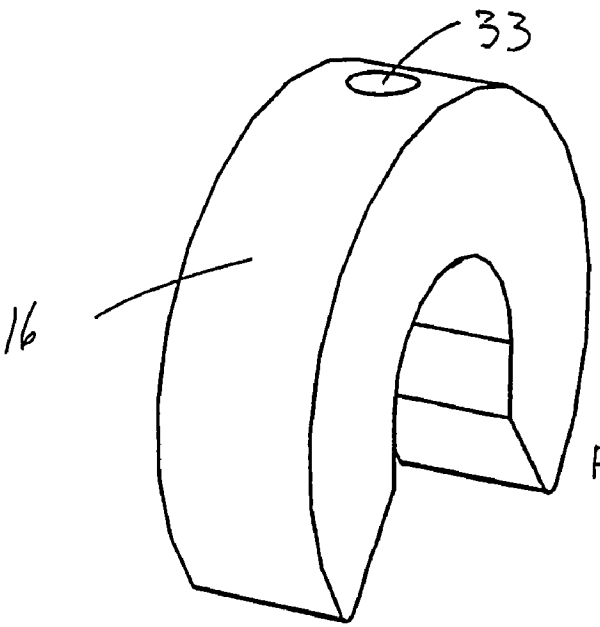
FIG. 3A is a perspective view of a spindle of the first embodiment.

As illustrated more particularly in FIG. 2 each disc body 11,12 is a hollow housing consisting of an outer cap 20 and an inner housing plate 21. In the embodiment illustrated in FIGS. 2A to 2C shaft 13 is mounted transversely to span across central apertures 18,19 of both inner housing plates in disc bodies 11, 12 respectively. One end of the shaft 13 is spring mounted onto a boss 22 on the interior of one of the outer caps 20. At this end, shaft 13 contains an axial recess 24 which is mounted over boss 22 and into which spring 26 extends.

The other end of shaft 13 is provided with a flange 27 that prevents the shaft escaping from central aperture 18 in disc body 11. This end of the shaft 13 may be secured tightly in central aperture 18 such that disc body 11 jointly moves with this end of shaft 13. The shaft may be glued into the central aperture 18 or be made to fit tightly in the aperture.

Two catches 29 are located in concave indentations 30 at the center of each inner housing plate 21. Catches 29 can be fixed one to each inner housing plate 21 adjacent aperture 18 or 19, or the catches 29 are simply positioned above shaft 13. Catches 29 are designed to hold the spindle 16 to which the string 15 is attached. Hence, spindle 16 is able to freely rotate about shaft 13 and is prevented from slipping therefrom by catches 29.

In an alternative embodiment catches 29 are not necessary as the spindle 16 may be retained on shaft 13 simply by way of the concave indentations 30 at the center of each inner housing plate 21. As illustrated in FIG. 2B, gap 14 reduces as disc body 11 and 12 close so that the spindle 16 is retained between the two disc bodies but the string 15 can still pass through the gap 14.

In the first embodiment, spindle 16 is a part circular clip with a semi-circular cut out center 32. The spindle encircles the shaft by approximately 180° and semi circular centre 32 sits on shaft 13. Centre 32 has a smooth, low friction surface to enable the spindle 13 to rotate about the shaft. A small aperture 33 at the top center of the spindle 16 opens into a larger aperture 34, which opens into the cut out 32. This configuration allows a string to be securely tied and connected to the spindle by threading the string through small aperture 33 and forming a knot at the string end which abuts against the larger aperture but is too large to slip through the smaller aperture 33.

In this embodiment, the string 15 can only be detached from the shaft when the disc bodies 11,12 are separated far enough to allow the spindle 16 to slip away from the shaft through gap 14. Release mechanism 17 is responsible for sufficiently separating the two disc bodies 11,12 to allow the spindle to escape from therebetween. Release mechanism 17 includes a trigger 40 and a release tab 42 that engages with a circumferential groove 44 on shaft 13.

In the embodiment illustrated in FIGS. 2A to 2C, trigger 40 is a lever that extends radially from the circumference of disc body 12 and is retained in the walls of the disc body to pivot at the pivot point 43 located close to the circumference of the disc body. Specifically, the trigger 40 has a transversely extending short shaft 46 that is received to pivot at point 43 in aperture 48 in the outer cap 20 of disc body 12. Referring to FIG. 2C, the trigger 40 pivots from the outward position illustrated in solid lines by 90° to one of the "down" positions illustrated by the dashed lines.

Release tab 42 lies in the same plane as trigger 40 and is biased to abut up against trigger 40 by tab spring 50 mounted in the interior circumference of disc body 12. Release tab 42 has a large rounded aperture 51 through which shaft 13 extends. A second smaller aperture 52 on the tab receives a screw 54 that fixes into inner housing plate 21 of disc body 12 to stably hold the release tab 42 in position. Release tab 42 is designed to shift in a planar direction against spring 50 in response to rotation of trigger 40. Apertures 51 and 52 are shaped so that release tab 42 can still move with respect to shaft 13 and screw 54.

The purpose of release tab 42 is to maintain shaft 13 in an axially restrained position against shaft spring 26. It does this by engaging an edge of aperture 51 in groove 44 of shaft 13 when the release tab is a rest position. The rest position is illustrated in FIGS. 2B and 2C where an edge of aperture 51 engages with groove 44 of the shaft to retain the shaft in the transverse position illustrated in FIG. 2B.

By pivoting trigger 40 lower shoulders 41 of trigger 40 are caused to push up against release tab 42 against the force of tab spring 50. This then moves aperture 51 relative to shaft 13 to disengage the release tab 42 from groove 44 of shaft 13. When release tab 42 has entirely disengaged from shaft 13 the potential force stored in shaft spring 26 will cause the shaft to move across laterally thereby moving disc body 11 away from disc body 12 and increasing the gap between two disc bodies. A widening of gap 14, as mentioned above, allows spindle 16 to be released from its position on shaft 13 and hence string 15 to be disconnected from the main disc body part of the spinning toy 10.

Trigger 40 is actuated when it encounters a force that causes it to pivot from its outwardly protruding position. The start position is illustrated in FIG. 2C. When a user spins the yo-yo up and down on the string trigger 40 will pivot when the spinning discs 11,12 come close to or in contact with a surface. The angular force of the spinning trigger hitting the surface will cause the trigger to pivot to one of the "down" positions illustrated in dash lines in FIG. 2C.

As trigger 40 pivots one of the lower shoulders 41 will cause tab 42 to release the shaft and widen the gap 14 between the two bodies to release the spring. Typically, in a game play this is best achieved when the yo-yo is "sleeping". While "sleeping" the user moves the spinning yo-yo close to a surface, such as the floor. As the yo-yo approaches the floor the trigger 40 hits the floor before the peripheral circumference of disc bodies 11,12. The force of the contact with the floor causes the trigger to pivot thereby releasing the string from the shaft between the disc bodies. With the string released the yo-yo travels across the surface, and if performed skillfully, in the manner of a rolling wheel.

String detachment and re-attachment of the present toy provides an added dimension of play over a regular yo-yo. The present spinning toy may continue to be used solely as a regular yo-yo: the string detachment feature can be deactivated by manually pivoting trigger 40 to the "down" position where the trigger does not protrude from the circumference of the disc body 12. Lower shoulders 41 of trigger 40 are designed such that they only cause release tab 42 to shift when the trigger has pivoted approximately 45° on either side of upright. At a pivoted movement of 90° the trigger does not apply a force against release tab, and the tab remains in the rest position firmly engaging shaft 13. Hence, the yo-yo can be played as a regular yo-yo with trigger 40 safely positioned inside the circumference of the spinning disc bodies.

Figure 5E:
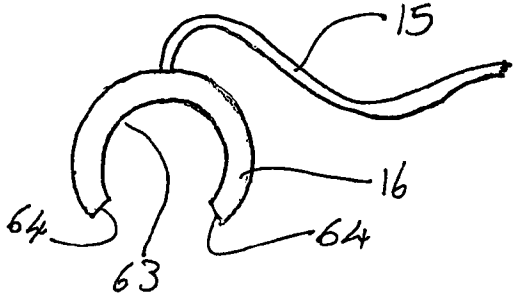
FIG. 5E illustrates a front view of a spindle in accordance with the second embodiment of the invention.
Figure 6:
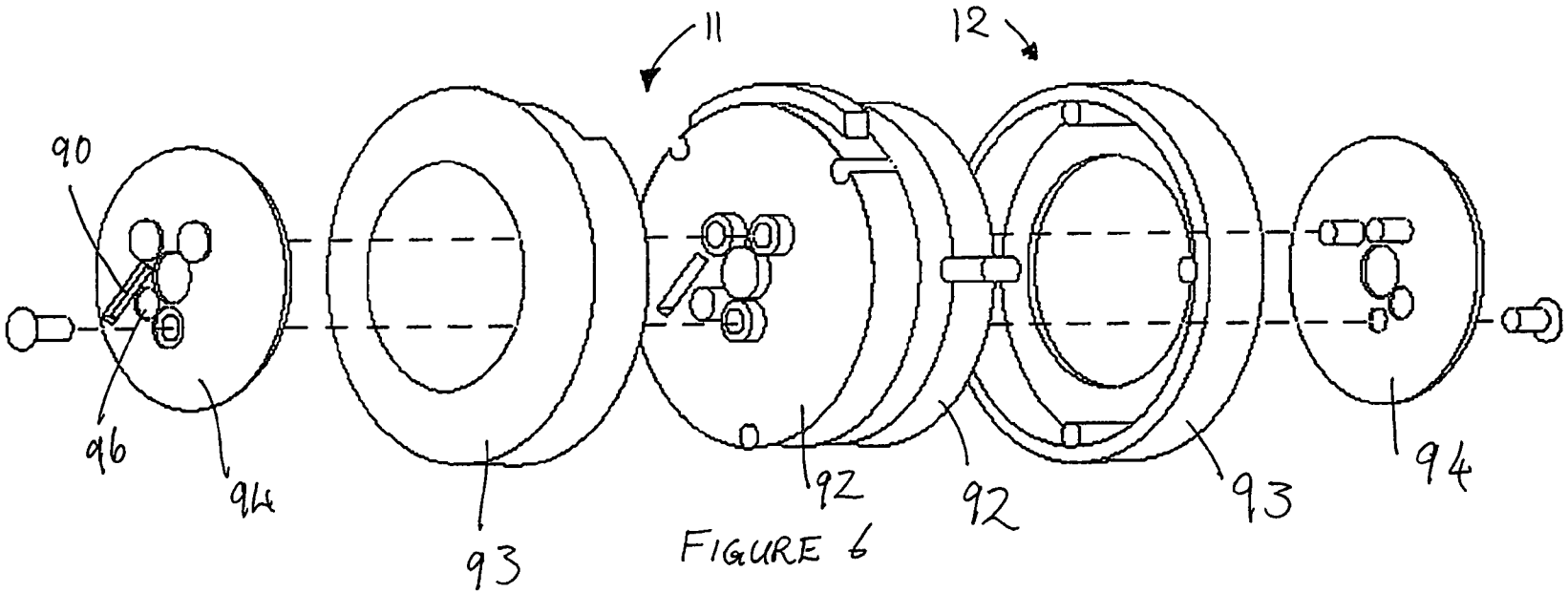
FIG. 6 is an exploded perspective view of the major components forming the second embodiment of the spinning toy.

FIGS. 4A to 8B illustrate a second embodiment of the spinning toy 10. As illustrated in FIG. 6, this embodiment contains two disc bodies 11,12 consisting of an inner housing plate 92, and an outer rim 93 containing outer cap 94. A transverse shaft 59 extends transversely through the co-axial centres of discs 11 and 12.

Figures 4A, 4B, 5A, 5B, 5C, 5D:
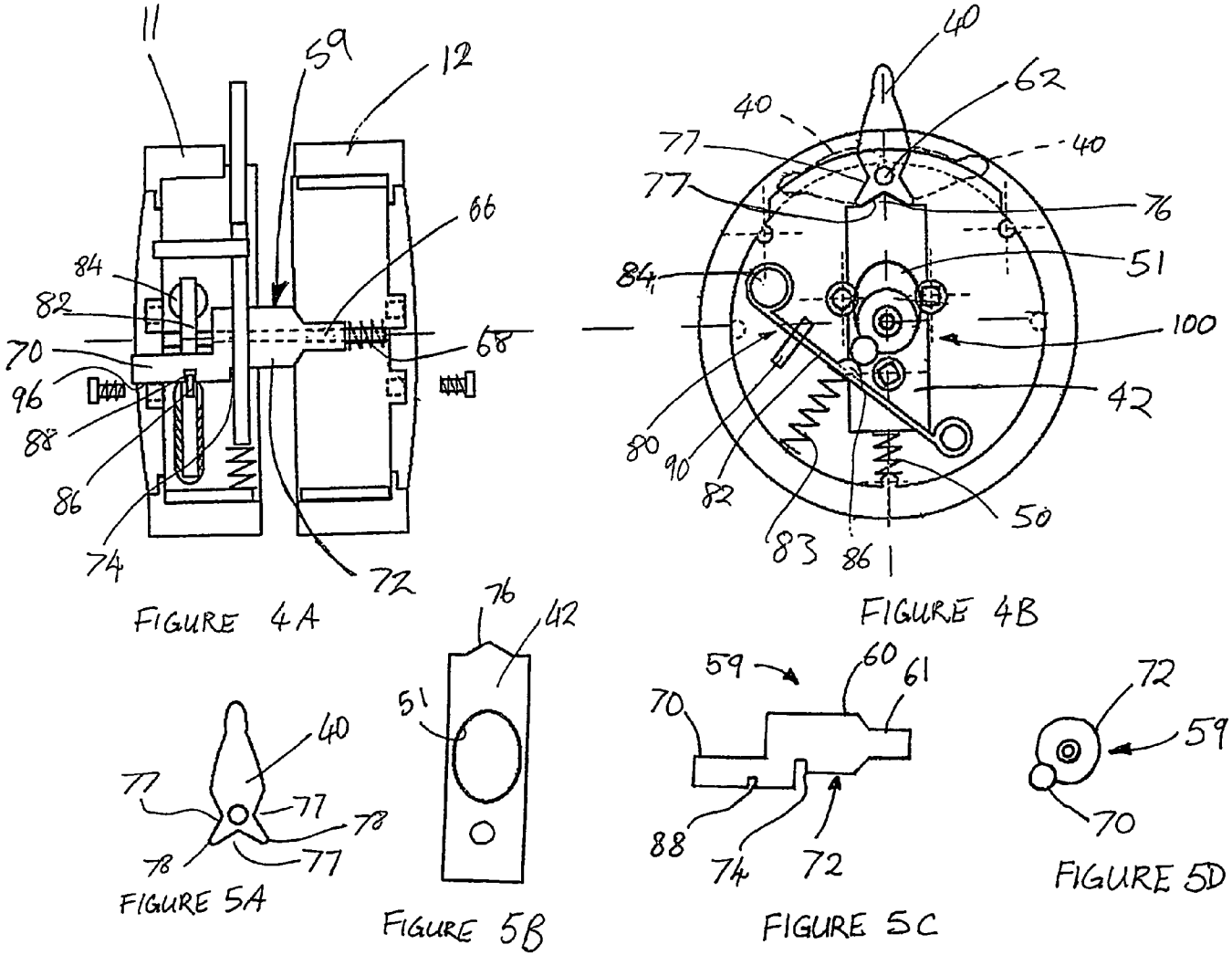
FIG. 4A is a side sectional view of a spinning toy according to a second embodiment of the invention.
FIG. 4B is a front sectional view of the second embodiment of the spinning toy.
FIG. 5A is a trigger of an embodiment of the spinning toy.
FIG. 5B is a front view of a tab of an embodiment of the spinning toy.
FIG. 5C is a side view of the shaft of an embodiment of the spinning toy.
FIG. 5D is an end view of the shaft of FIG. 5C.

However, shaft 59 in this embodiment is shaped differently from the first embodiment and the spindle 16 relies on a different technique for detachment from the shaft 59. Shaft 59 is illustrated in FIGS. 5C and 5D and spindle 16 is illustrated in FIG. 5E. At a main spinning portion 72 the shaft has a large diameter 60 adjacent a small shaft diameter 61.

In this embodiment shaft 59, during normal yo-yoing conditions, exposes the large shaft diameter 60 in gap 14. In order to release the spindle 16 from the shaft, the release mechanism activates to shift shaft 13 axially to expose the small shaft diameter 61 in gap 14. The spindle 16 is shaped such that when large shaft diameter 60 is exposed in the gap 14, the spindle maintains its attachment on the shaft. However, as the shaft is shifted to expose the small shaft diameter the spindle is freed from the shaft.

Turning to FIG. 5E, spindle 16 takes form of a "C" shaped circular member. The spindle encircles the shaft by more than 180° but less than 360° so that the large diameter 60 extends comfortably through an internal opening 63 of spindle 16 but a gap exists to allow the smaller diameter to slip out of the internal opening 63. On the large diameter 60 spindle 16 is unable to slip radially off the shaft. However, the small shaft diameter 61 is made smaller than the distance between the ends 64 of the spindle so that the spindle can slip radially off the small shaft diameter 61.

Turning back to FIG. 4A, in this embodiment shaft 59 is spring mounted on axle 66 that extends centrally from one disc body to the other. Spring 68 is mounted on axle 66 to abut against one end of shaft 59 in disc body 12. Extending into disc body 11, shaft 59 has a radial step 75 in a manner to continue extending shaft 59 along a secondary leg 70 that lies on an axis that is parallel to the axis of the main spinning portion 72 of the shaft 59. Secondary leg 70, being offset to the central axle 66, rotates about the axle 66.

Release mechanism 100 as illustrated in FIG. 4B and in this embodiment operates along the same principles as with the first embodiment. All similar features are referenced using the same reference numerals as used for the first embodiment.

Release mechanism 100 includes a release tab 42 spring mounted on tab spring 50 against a circumferential interior of disc body 11. The aperture 51 of release tab 42 in this embodiment is oval (as illustrated in FIGS. 4B and 5B) and the edge of the aperture is designed to engage with a recess 74 of shaft 59. The top end of release tab 42 that abuts against trigger 40 has a projection 76 that complementary engages with a holding recess 77 in trigger 40.

Trigger 40 is illustrated in FIG. 5A and includes three such holding recesses 77 defined by two lower shoulders 41 at the pivot point 62 end of trigger 40. Recesses 77 are designed to maintain release tab 42 in a more stable rest position regardless of whether the trigger 40 is extending radially from the circumference of the yo-yo or is in a "down" position as illustrated by the dashed lines in FIG. 4B. As trigger 40 is rotated through 90° from the extended position to the down position, one of the lower shoulders 78 will exert a force against release tab 42 pushing it against tab spring 50 in order to release tab 42 from recess 74 of shaft 59. Releasing the shaft 59 in this manner will cause the shaft to move axially under the force of shaft spring 68 and towards a direction to the left of the view illustrated in FIG. 4A.

However, in this embodiment even with the disengagement of shaft 59 from release tab 42 the shaft will not immediately shift axially because a clutch 80 is provided as a safety measure to prevent movement of the shaft 59 unless the correct conditions are achieved. The correct conditions to be achieved in order to release the string from the shaft are:

(1) the disc bodies are spinning at a sufficiently high speed to reach a predetermined centrifugal force to release clutch 80; and (2) the trigger, when extended, encounters a force sufficient to make the trigger pivot.

Clutch 80 is best illustrated in FIG. 4B. It is defined by an elongated arm 82 that extends across a segment of the interior of one of the disc bodies 11,12, which in this case is disc body 11. Clutch arm 82 is spring mounted by clutch spring 83 at an approximate centre of the arm to an internal circumference of disc body 11. One end 84 of the arm is weighted with a metal weight or the like. Hence, as the yo-yo spins the centrifugal force inside disc body 11 causes clutch arm 82, and particularly weighted and 84, to move towards the circumference of the disc body. Clutch 80 engages with the secondary leg 70 of shaft 59 by way of a lug 86 located on one side of clutch arm 82. Lug 86 engages with a lug recess 88 in secondary leg 70. Lug 86 is positioned approximately on the other side of clutch arm 82 from clutch spring 83.

An opening 90 in the outer cap 94 of disc body 11 allows a user to manually push down clutch arm 82 to disengage clutch 80 from shaft 59. This feature may be useful, for example, where after string disconnection the shaft 59 is locked back into position but inadvertently without first placing the spindle on the shaft. By inserting a pointed object through cap opening 90 the clutch 80 can be disengaged from the shaft 59 and trigger 40 may be pivoted to allow the release mechanism to release shaft 59 thereby exposing the small shaft diameter 61 which will allow a user to reinsert spindle 16 onto the shaft 59. Without this feature it would be difficult to unlock shaft 59 and reinsert spindle 16.

As shaft 59 is released and shifts to reveal to the small diameter 61, the secondary leg 70 projects further out of a corresponding aperture 96 in outer cap 94 of disc body 11.

Figures 7A, 7B, 8A, 8B:
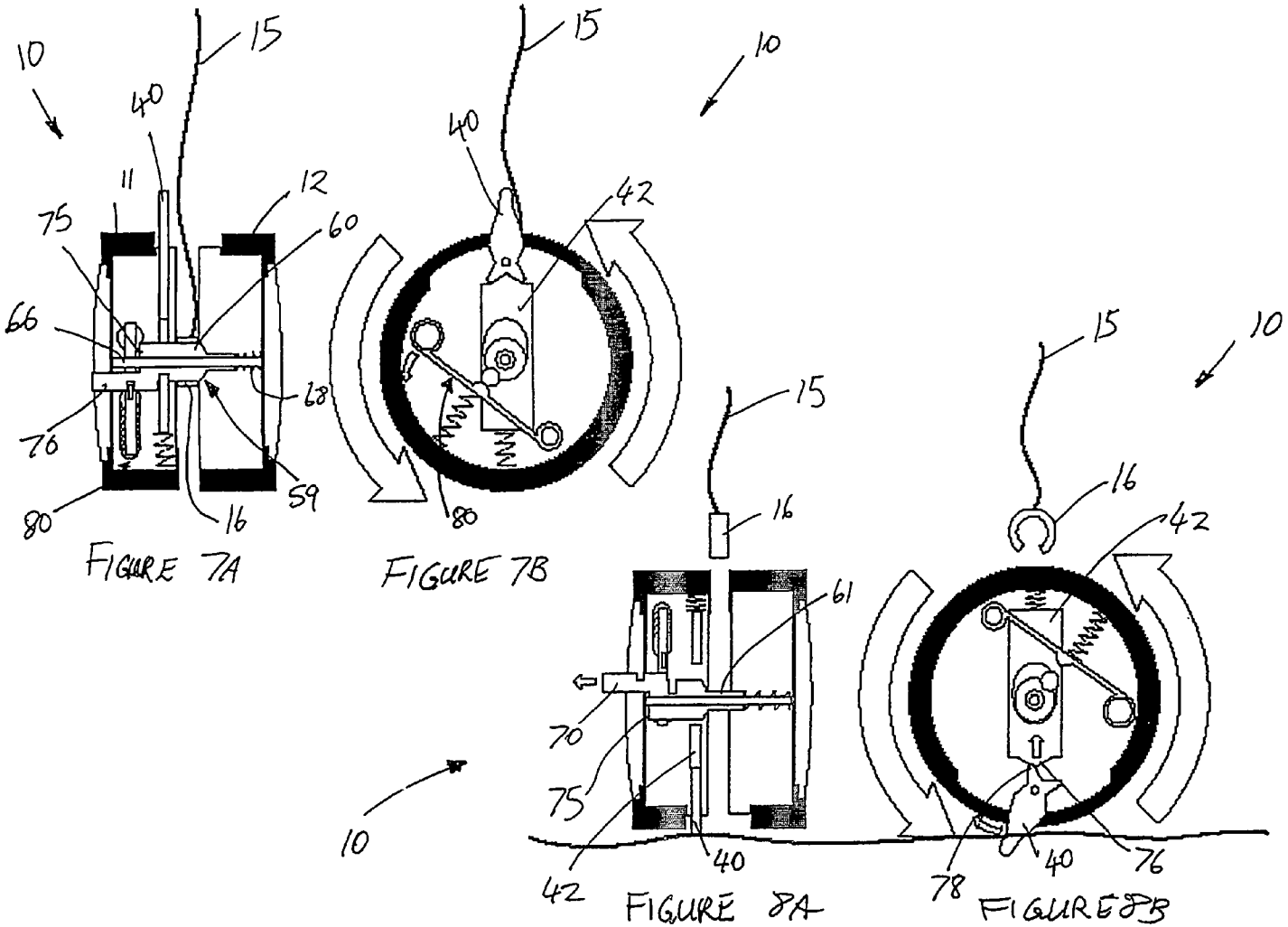
FIG. 7A is a side sectional view of an embodiment of the spinning toy spinning on the string.
FIG. 7B is a front sectional view showing the embodiment of FIG. 7A.
FIG. 8A is a side sectional view illustrating an embodiment of the spinning toy with string detached.
FIG. 8B is a front sectional view of the embodiment of FIG. 8A.

FIGS. 7A and 7B illustrate in front and side sectional views the spinning yo-yo toy 10 in a yo-yo operating condition. In this condition the string 15 by way of spindle 16 is attached to shaft 59 to rotate relative to the shaft. Slowly spinning, the trigger 40 is illustrated in an extended position, release tab 42 is engaged with shaft 59 and clutch 80 is also engaged with shaft 59.

FIGS. 8A and 8B illustrate the yo-yo reaching a relatively high rotational speed and being lowered close to the ground. As the circumference of the yo-yo nears the ground trigger 40 comes into contact with the ground and pivots about pivot point 62 which causes lower shoulder 41 to move release tab 42 up against tab spring 50 thereby releasing from engagement shaft 59. Simultaneously, the centrifugal force created by the spinning disc bodies causes the weighted end 84 of clutch arm 82 to urge away from shaft 59 thereby disengaging clutch 80 from shaft 59.

When both the release mechanism 17 and clutch 80 are disengaged from shaft 59, the shaft is free to move under the force of shaft spring 68 to expose the small shaft diameter 61 from which spindle 16 can detach. To prevent complete separation of the disc bodies, shaft 59 is prevented from escaping entirely from disc body 12 by step 75.

Once detached from the string the yo-yo will continue to rotate under an inertia force and roll along the ground. To reassemble the yo-yo, the string on the spindle is mounted back onto the small shaft diameter 61 and in that position the secondary leg 70 of shaft 59 is pushed inward of disc body 11, in the direction opposite to the arrow illustrated in FIG. 8A, to mount the spindle back onto the large shaft diameter 60. In an alternative embodiment the two disc bodies may be entirely separable or manually pulled further apart to facilitate mounting of the spindle on the shaft.

While the present spinning yo-yo toy can operate without a clutch 80, a clutch is preferred for the sake of safety. Clutch 80 prevents shaft 59 from moving if release mechanism 100 is activated in a child's hand or while the yo-yo is not spinning.

The present spinning toy adds an extra playing dimension to yo-yo's as they are currently known. In addition to the normal versatility of yo-yo toys, the present spinning toy allows the creation of new tricks and raises the level of skill in commanding a yo-yo. One of the added game skills involves smooth and accurate release of the string to encourage the rolling discs to travel as far as possible.

Variations to the internal working mechanisms of the yo-yo are possible for achieving the same result of disconnecting the string while the yo-yo is in play. Two different embodiments have already been described and further variations conceivably fall within the spirit and scope of the spinning toy as defined by the claims.

The invention claimed is:

1. A spinning toy comprising a pair of spaced disc bodies connected by a transverse shaft forming a gap therebetween, a string attached to a spindle wherein the spindle is coupled to the shaft in the gap such that the disc bodies can be spun relative to the string, and a release mechanism for uncoupling the spindle from the shaft while the toy is spinning thereby separating the string and spindle from the disc bodies.

2. The spinning toy claimed in claim 1, wherein the release mechanism protrudes radially from the circumference of one of the disc bodies and is activated to release the string from the shaft in response to a force on the release mechanism.

3. The spinning toy claimed in claim 1, wherein the string is affixed to the spindle through an aperture in the spindle.

4. The spinning toy claimed in claim 2, wherein the string is affixed to the spindle through an aperture in the spindle.

5. The spinning toy claimed in claim 1, wherein the release mechanism urges the shaft to move axially to release the spindle from the shaft and thereby allow the string to detach from the shaft.

6. The spinning toy claimed in claim 5, wherein one end of the shaft is spring mounted inside one of the disc bodies.

7. The spinning toy claimed in claim 5, wherein the spindle is captured between the disc bodies and held therebetween on the shaft, and whereby an axial movement of the shaft widens the gap between the disc bodies, hence releasing the spindle.

8. The spinning toy claimed in claim 7, wherein catches in the gap assist in holding the spindle on the shaft.

9. The spinning toy claimed in claim 5, wherein the shaft is provided with two different sized diameters, wherein the spindle is attached to the shaft at the larger diameter and axial movement of the shaft exposes the smaller diameter thereby allowing the spindle to detach from the shaft.

10. The spinning toy claimed in claim 1, wherein the release mechanism includes a trigger protruding from the circumference of one of the disc bodies and a biased tab moveable in response to movement of the trigger, whereby movement of the tab releases the shaft to axial movement.

11. The spinning toy claimed in claim 10, wherein the tab has an elongate or large round opening through which the biased shaft extends and is held therein.

12. The spinning toy claimed in claim 10, wherein the trigger is a lever pivoted to the disc body containing the release mechanism.

13. The spinning toy claimed in claim 1, wherein the trigger is a lever pivoted to the disc body containing the release mechanism.

14. The spinning toy claimed in claim 1, further including a clutch engageable with the shaft that prevents axial movement of the shaft, and that disengages from the shaft, when the spinning toy achieves a predetermined centrifugal forces.

15. The spinning toy claimed in claim 14, wherein the clutch is weighted and spring mounted to an interior circumference of a disc body.

16. The spinning toy claimed in claim 15, wherein the clutch is an elongate arm that is spring mounted to the interior circumference of the disc body at an approximate center of the arm and has a lug at an approximate center that engages with a complementary slot in the shaft such that the clutch releases the shaft when centrifugal forces cause the clutch to move toward the interior circumference.

17. The spinning toy claimed in claim 12, wherein the trigger pivots approximately 90° in either direction from an extended position to a down position.

18. The spinning toy claimed in claim 7, wherein the spindle is a part circular shape that encircles the shaft by approximately 180°.

19. The spinning toy claimed in claim 9, wherein the spindle is a part circular shape that encircles the larger diameter of the shaft by more than 180° but less than 360°.

20. A method of using a spinning toy having a pair of spaced disc bodies connected by a transverse shaft forming a gap therebetween, and a string attached to a spindle wherein the spindle is coupled to the shaft in the gap, the method including:

spinning the connected disc bodies relative to the string by unwinding the disc bodies from the string;

lowering the spinning disc bodies towards a surface to activate a release mechanism that releases the string from the shaft thereby separating the string and spindle from the disc bodies; and retaining hold of the string while allowing the disc bodies to freely roll along a surface.

* * * * *

UNITED STATES PATENT AND TRADEMARK OFFICE

CERTIFICATE OF CORRECTION

PATENT NO. : 7,059,932 B1
APPLICATION NO. : 10/512032
DATED : June 13, 2006
INVENTOR(S) : Tobias et al.

It is certified that error appears in the above-identified patent and that said Letters Patent is hereby corrected as shown below:

Face of the Patent, See Item (57) ABSTRACT, line 3, "A sting is attached" should read -- A string is attached --

Column 8, Line 8, Claim 14, "forces" should read -- force --

Signed and Sealed this

Tenth Day of October, 2006

JON W. DUDAS
*Director of the United States Patent and Trademark Office*